US008277576B2

(12) United States Patent
Pelsoeczy

(10) Patent No.: US 8,277,576 B2
(45) Date of Patent: Oct. 2, 2012

(54) STEEL MATERIAL COMPOSITION FOR PRODUCING PISTON RINGS AND CYLINDER LINES

(75) Inventor: Laszlo Pelsoeczy, Burscheid (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 0 days.

(21) Appl. No.: 13/203,596

(22) PCT Filed: Oct. 13, 2009

(86) PCT No.: PCT/EP2009/007357

§ 371 (c)(1), (2), (4) Date: Aug. 26, 2011

(87) PCT Pub. No.: WO2010/097107

PCT Pub. Date: Sep. 2, 2010

(65) Prior Publication Data

US 2011/0305592 A1 Dec. 15, 2011

(30) Foreign Application Priority Data

Feb. 26, 2009 (DE) ..... 10 2009 010 726

(51) Int. Cl.
*C22C 38/20* (2006.01)

(52) U.S. Cl. ..... 148/221; 148/334; 420/110

(58) Field of Classification Search ..... 420/84, 420/582, 583, 586.1, 90, 34, 61, 60, 63, 67, 420/69, 8, 110; 164/47; 148/221, 538, 542, 148/548, 318, 325, 38, 321, 333, 334
See application file for complete search history.

(56) References Cited

U.S. PATENT DOCUMENTS

| | | | | |
|---|---|---|---|---|
| 2,165,035 | A | 7/1939 | Delong et al. | |
| 2,280,284 | A * | 4/1942 | Critchett et al. | 420/83 |
| 4,435,226 | A * | 3/1984 | Neuhauser et al. | 148/545 |
| 4,957,702 | A | 9/1990 | Fang et al. | |
| 5,352,271 | A * | 10/1994 | Margaria et al. | 75/526 |
| 7,052,019 | B2 * | 5/2006 | Miida | 277/443 |
| 2002/0005616 | A1 | 1/2002 | Kubota | |
| 2006/0191508 | A1 * | 8/2006 | Otsuka et al. | 123/193.6 |
| 2010/0192895 | A1 | 8/2010 | Pelsoeszy | |

FOREIGN PATENT DOCUMENTS

| | | |
|---|---|---|
| GB | 124 817 A | 4/1919 |
| JP | 07 278742 A | 10/1995 |

* cited by examiner

*Primary Examiner* — George Wyszomierski
*Assistant Examiner* — Michael Aboagye
(74) *Attorney, Agent, or Firm* — Robert L. Stearns; Dickinson Wright, PLLC

(57) ABSTRACT

A steel material composition, in particular for producing piston rings and cylinder sleeves, contains the following elements in the cited fractions relative to 100% by weight of the steel material: 0.5-1.2% by weight C, 0-3.0% by weight Cr, 72.0-94.5% by weight Fe, 3.0-15.0% by weight Mn and 2.0-10.0% by weight Si. It can be produced by melting the starting materials and casting the melt into a pre-fabricated mold.

5 Claims, No Drawings

STEEL MATERIAL COMPOSITION FOR PRODUCING PISTON RINGS AND CYLINDER LINES

BACKGROUND OF THE INVENTION

1. Technical Field

The present invention relates to a piston ring. The present invention further relates to a method for manufacturing the piston rings according to the invention.

2. Related Art

Piston rings in a combustion engine seal the gap that exists between the piston head and the cylinder wall off from the combustion chamber. As the piston moves up and down, the outer peripheral surface of the piston ring slides along the cylinder wall in permanently spring-biased contact therewith, while the piston ring itself oscillates as it travels in its piston ring groove due to the tilting movements of the piston, and this oscillation causes the flanks of the ring come into contact alternatingly with the upper and lower flanks of the piston ring groove. As the two elements slide over one another, each is subject to a certain amount of wear depending on the nature of the material, and in the event of dry running this can lead to seizing, scoring and ultimately cause irreparable damage to the engine. In order to improve the sliding and wearing behaviour of piston rings with respect to the cylinder wall, the peripheral surfaces of the piston rings have been coated with various materials.

The parts of internal combustion engines that are exposed to high stresses, such as piston rings, are usually made from cast iron materials or cast iron alloys. Piston rings and particularly compression rings in high-performance engines are exposed to increasing stresses, including peak compression pressure, combustion temperature, EGR and lubrication film reduction among others, and which have a critical effect on their functional properties, such as wear scuff resistance, microwelding and corrosion resistance.

Unfortunately, cast iron materials according to the prior art are highly susceptible to breakage, and rings often break when the existing materials are used. Higher mechanical-dynamic loads result in shorter operating lives for piston rings. Running surfaces and flanks are subject to heavy wear for the same reasons.

Higher ignition pressures, reduced emissions and direct fuel injection contribute to increased loads on the piston rings. As a result, the piston material is damaged and deposits accumulate on it, particularly on the lower piston ring flank.

Having to deal with higher mechanical and dynamic loads on piston rings, more and more engine manufacturers are requesting piston rings that are made from high-grade steel (annealed and high-alloyed, such as the material 1.4112). In this context, iron materials containing less than 2.08% by weight carbon are classified as steel. If the carbon content is higher, the material is considered to be cast iron. Steel materials have better strength properties and ductile values than cast iron because their microstructures are not disrupted by free graphite.

The steels used most frequently to produce steel piston rings are high chrome alloy, martensitic steels. Steel piston rings are manufactured from profile wire. The profile wire is roundwound, cut to length and drawn over an "out-of-round" mandrel. On this mandrel, the piston ring is given its desired out-of-round shape in an annealing process, which also sets up the requisite tangential forces. A further disadvantage of manufacturing piston rings from steel is that above a certain diameter, it is no longer possible to produce (wind) rings from steel wire. In contrast, cast iron piston rings are already cast out of round, so they are ideally shaped from the outset.

Cast iron has a considerably lower melting temperature than steel. The difference may be as much as 350° C. depending on chemical composition. Cast iron is therefore easier to melt and cast, since a lower melting temperature means a lower casting temperature and thus also less shrinkage due to cooling, so that the case material has few blowholes and/or hot or cold cracks. A lower casting temperature also generates less stress on the moulding material (erosion, gas porosities, sand inclusions) and the furnace as well as lower melting costs.

The melting temperature of the iron material depends not only on its carbon content but also on the "degree of saturation". The following formula, shown in simplified form, applies:

$$S_c = C/(4.26 - l/3(Si+P)).$$

The closer the degree of saturation is to 1, the lower the melting temperature is. In the case of cast iron, a degree of saturation of 1.0 is usually aimed for, wherein the cast iron has a melting temperature of 1150° C. The degree of saturation of steel is about 0.18 depending on its chemical composition. Eutectic steel has a melting temperature of 1500° C.

The degree of saturation can be influenced considerably by the Si or P content. For example a 3% by weight increase in silicon content has a similar effect to a 1% by weight increase in C content. It is thus possible to produce a steel material having a C content of 1% by weight and 9.78% by weight silicon that has the same melting temperature as cast iron with a degree of saturation of 1.0 (C: 3.26% by weight, Si: 3.0% by weight).

If the Si content is increased significantly, the degree of saturation of the steel material may also be increased and the melting temperature lowered to the same level as cast iron. In this way, it is possible to produce steel using the same equipment as is used to produce cast iron, for example GOE 44.

Piston rings made from a steel casting material with high silicon content are known in the prior art. However, the presence of a larger quantity of silicon has a negative effect on the hardenability of the material, because its "Ac3" austenitic conversion temperature is raised.

BRIEF DESCRIPTION OF THE INVENTION

In view of the above, the object of the present invention is to provide piston rings having a steel material composition with high silicon content as the basic element thereof and having improved hardenability. Due to its production in a gravity casting process, the steel material composition should improve on the properties of annealed cast iron with spheroidal graphite with respect to at least one of the following parameters:

- Mechanical properties such as e-modulus, bending strength
- Resistance to breakage
- Mechanical stability
- Flank wear
- Running surface wear This object is solved according to the invention with piston rings that have a steel material composition as the basic element thereof including the following elements in the proportions indicated:

| | |
|---|---|
| C: | 0.5-1.2% by weight |
| Cr: | 0-3.0% by weight |
| Fe: | 72.0-94.5% by weight |
| Mn: | 3.0-15.0% by weight |
| Si: | 2.0-10.0% by weight |

| | |
|---|---|
| Al: max. 0.02% by weight | P: max. 0.1% by weight |
| B: max. 0.1% by weight | S: max. 0.05% by weight |
| Cu: max. 2.0% by weight | Sn: max 0.05% by weight |
| Mo: max. 3.0% by weight | Ti: max. 1.5% by weight |
| Nb: max. 0.05% by weight | V: max. 1.5% by weight |
| Ni: max. 4.0% by weight | W: max. 1.5% by weight |

wherein the sum of the fractions of Nb, Ti, V and W is not more than 1.5% by weight, and the steel material composition only contains elements selected from the group consisting of Al, B, C, Cr, Cu, Fe, Mn, Mo, Nb, Ni, P, S, Si, Sn, Ti, V and W, wherein the sum of these elements is equal to 100% by weight.

The manganese contained functions as an austenite former that extends the gamma range and shifts the Ac3 austenitic conversion temperature upwards. In this way, improved hardenability of the steel material is achieved according to the invention.

The piston rings according to the invention are less susceptible to becoming deformed in the presence of extreme heat, and thus retain high performance capability for the long term while also reducing oil consumption.

The piston rings according to the invention also have the advantage that it thus becomes possible to manufacture steel piston rings using the machinery and technologies that are normally used for manufacturing cast iron workpieces. Moreover, the production costs are equivalent to those for cast iron piston rings, affording the manufacturer a cost advantage and improved value creation.

The material parameters are also adjustable independently of the supplier.

Piston rings according to the invention are produced in a process that includes the following steps:

a. Producing a melt from the starter materials, and b. Pouring the melt into a prefabricated mould.

Steel scrap, recycled material and alloys, for example, may be used as starter materials. The smelting process takes place in a furnace, preferably a cupola furnace. Following this, the melt is allowed to solidify to produce a blank. The piston ring may be cast using methods known in the related art, such as centrifugal casting, continuous casting, punch pressing methods, Croning, or preferably green sand moulding.

After the piston ring has cooled, the form is emptied and the blank obtained is cleaned.

If necessary, the piston ring may then be annealed. This is done in the following steps:

c. Austenitising the piston ring above its Ac3 temperature, d. Quenching the piston ring in a suitable quenching medium, and e. Tempering the piston ring at a temperature in the range from 400 to 700° C. in a controlled atmosphere furnace.

Oil is preferably used as the quenching medium.

To harden the piston ring according to the invention further, the piston ring obtained thereby may be nitrided following the process steps described in the preceding.

This may be performed for example by gas nitriding, plasma nitriding or pressure nitriding.

DETAILED DESCRIPTION

The following example explains the invention without being limited thereto.

Example

A piston ring was produced from a steel material composition according to the invention having the following composition:

| | |
|---|---|
| Al: 0.002% by weight | P: 0.03% by weight |
| B: 0.1% by weight | S: 0.009% by weight |
| C: 0.7% by weight | Si: 3.0% by weight |
| Cr: 2.0% by weight | Sn: 0.001% by weight |
| Cu: 0.05% by weight | Ti: 0.007% by weight |
| Mn: 5.05% by weight | V: 0.015% by weight |
| Mo: 0.5% by weight | W: 0.011% by weight |
| Nb: 0.002% by weight | Fe: Remainder |

This was done by producing a melt of the starter materials (steel scrap, recycled material and alloys), and pouring the melt into a prefabricated green sand mould. Then, the mould was emptied and the piston ring thus obtained was cleaned. The piston ring was then annealed. This is achieved by austenitising above the Ac3 temperature of the steel material composition, quenching in oil, and tempering in a controlled atmosphere furnace at a temperature in the range from 400 to 700° C.

What is claimed is:

1. A piston ring, including a cast steel material composition as the basic element thereof, wherein the steel material composition consists of the following elements in the proportions indicated relative to 100% by weight of the steel material composition:

| | |
|---|---|
| C: | 0.5-1.2% by weight |
| Cr: | 0-3.0% by weight |
| Fe: | 72.0-94.5% by weight |
| Mn: | 3.0-15.0% by weight |
| Si: | 2.0-10.0% by weight |
| Al: | max. 0.02% by weight |
| B: | max. 0.1% by weight |
| Cu: | max. 2.0% by weight |
| Mo: | max. 3.0% by weight |
| Nb: | max. 0.05% by weight |
| Ni: | max. 4.0% by weight |
| P: | max. 0.1% by weight |
| S: | max. 0.05% by weight |
| Sn: | max 0.05% by weight |
| Ti: | max. 1.5% by weight |
| V: | max. 1.5% by weight |
| W: | max. 1.5% by weight |

wherein the sum of the fractions of Nb, Ti, V and W is not more than 1.5% by weight.

2. The piston ring as recited in claim 1 wherein the steel material composition includes:

| | |
|---|---|
| C: | 0.5-0.7% by weight, and |
| Mn: | 5.05-15.0% by weight. |

3. A method for producing a piston ring comprising a. Producing a melt from a steel material composition consisting of

| | |
|---|---|
| C: | 0.5-1.2% by weight |
| Cr: | 0-3.0% by weight |
| Fe: | 72.0-94.5% by weight |
| Mn: | 3.0-15.0% by weight |
| Si: | 2.0-10.0% by weight |
| Al: | max. 0.02% by weight |
| B: | max. 0.1% by weight |
| Cu: | max. 2.0% by weight |
| Mo: | max. 3.0% by weight |
| Nb: | max. 0.05% by weight |
| Ni: | max. 4.0% by weight |
| P: | max. 0.1% by weight |
| S: | max. 0.05% by weight |
| Sn: | max 0.05% by weight |

-continued

| | |
|---|---|
| Ti: | max. 1.5% by weight |
| V: | max. 1.5% by weight |
| W: | max. 1.5% by weight |

wherein the sum of the fractions of Nb, Ti, V and W is not more than 1.5% by weight.

4. The method of claim 3, further including:

c. Austenitising the piston ring above its Ac3 temperature, d. Quenching the piston ring in a suitable quenching medium, and e. Tempering the piston ring at a temperature in the range from 400 to 700° C. in a controlled atmosphere furnace.

5. The method as recited in claim 4, wherein the production of the piston ring further includes the following step:

f. Nitriding the piston ring obtained.

* * * * *

UNITED STATES PATENT AND TRADEMARK OFFICE

CERTIFICATE OF CORRECTION

PATENT NO. : 8,277,576 B2
APPLICATION NO. : 13/203596
DATED : October 2, 2012
INVENTOR(S) : Pelsoeczy It is certified that error appears in the above-identified patent and that said Letters Patent is hereby corrected as shown below:

On the Title Page, Item [57]

Abstract "cylinder sleeves, contains" should read "cylinder liners, comprises"
Abstract "cited fractions" should read "listed quantities"
Abstract "It can be produced by melting" should read "The composition can be produced by producing a melt of"

Signed and Sealed this
Eighteenth Day of June, 2013

Teresa Stanek Rea
*Acting Director of the United States Patent and Trademark Office*